US011618985B2

(12) United States Patent
Detty et al.

(10) Patent No.: US 11,618,985 B2
(45) Date of Patent: Apr. 4, 2023

(54) SEGMENTED NEEDLE BAR TUFTING ON VARIABLE GAUGE TUFTING APPARATUS

(71) Applicant: Tuftco Corporation, Chattanooga, TN (US)

(72) Inventors: Jason Daniel Detty, Chattanooga, TN (US); Steven L. Frost, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 101 days.

(21) Appl. No.: 17/175,563

(22) Filed: Feb. 12, 2021

(65) Prior Publication Data

US 2021/0269955 A1 Sep. 2, 2021

Related U.S. Application Data

(60) Provisional application No. 62/975,256, filed on Feb. 12, 2020.

(51) Int. Cl.
*D05C 15/30* (2006.01)
*D05C 15/10* (2006.01)
*D05C 15/18* (2006.01)

(52) U.S. Cl.
CPC ..... *D05C 15/30* (2013.01); *D05C 15/10* (2013.01); *D05C 15/18* (2013.01)

(58) Field of Classification Search
CPC ..... D05C 15/12; D05C 15/14; D05C 15/20; D05C 15/22; D05C 15/10; D05C 15/30; D05C 15/18; D05C 15/28
See application file for complete search history.

(56) References Cited

U.S. PATENT DOCUMENTS

| | | | | | |
|---|---|---|---|---|---|
| 4,483,261 | A * | 11/1984 | Green | D05C 15/20 | 112/80.45 |
| 4,519,326 | A * | 5/1985 | Green | D05C 15/20 | 112/80.45 |
| 4,630,558 | A * | 12/1986 | Card | D05C 15/30 | 112/410 |
| 4,662,291 | A * | 5/1987 | Bardsley | D05C 15/20 | 112/80.41 |
| 5,158,028 | A * | 10/1992 | Beyer | D05C 15/20 | 112/80.45 |
| 5,499,588 | A * | 3/1996 | Card | D05C 15/30 | 112/80.52 |
| 9,290,874 | B2 * | 3/2016 | Mathews | D05C 15/28 | |
| 10,889,931 | B2 * | 1/2021 | Beatty | D05C 15/14 | |
| 2002/0170477 | A1 * | 11/2002 | Vaughan | D05C 15/12 | 112/80.4 |
| 2014/0283724 | A1 * | 9/2014 | Frost | D05C 15/30 | 112/475.23 |
| 2015/0211161 | A1 * | 7/2015 | Card, Sr. | D05C 15/12 | 112/80.4 |
| 2017/0096757 | A1 * | 4/2017 | Hall | D05C 15/32 | |
| 2020/0173084 | A1 * | 6/2020 | Pass | D04B 27/06 | |

* cited by examiner

*Primary Examiner* — Danny Worrell
(74) *Attorney, Agent, or Firm* — Miller & Martin PLLC

(57) ABSTRACT

A backing feed is utilized with a tufting machine having reciprocating needles and gauge parts for seizing yarns wherein the needles are configured in consecutive gauge positions in alternate segments in front and rear transverse rows of needles, and the position of the needles is shiftable transversely with respect to the backing.

20 Claims, 21 Drawing Sheets

SEGMENTED NEEDLE BAR TUFTING ON VARIABLE GAUGE TUFTING APPARATUS

The present application claims the benefit of U.S. Provisional Ser. No. 62/975,256 filed Feb. 12, 2020.

FIELD OF THE INVENTION

This invention relates to tufting machines and more particularly to a method and apparatus for employing blocked or segmented needle bars while shifting the lateral position of the backing fabric relative to the needles during tufting in a fashion that can allow for increasing (or decreasing) the density of the pile fabric produced, and further to providing patterning and yarn placement effects in the resulting tufted fabrics.

BACKGROUND OF THE INVENTION

In the production of tufted fabrics, a plurality of spaced yarn carrying needles extend transversely across the machine and are reciprocated cyclically to penetrate and insert pile into a backing material fed longitudinally beneath the needles. During each penetration of the backing material a row of pile is produced transversely across the backing. Successive penetrations result in longitudinal columns of pile tufts produced by each needle. This basic method of tufting limits the aesthetic appearance of tufted fabrics. Thus, the prior art has developed various procedures for initiating relative lateral movement between the backing material and the needles in order to laterally displace longitudinal rows of stitching and thereby create various pattern effects, to conceal and display selected yarns, to break up the unattractive alignment of the longitudinal rows of tufts, and to reduce the effects of streaking which results from variations in coloration of the yarn.

Another reason for initiating relative lateral movement between the needles and the backing material is to increase the density of the fabric by placing the stitches closer together laterally than the gauge of the machine. It has been most common in broadloom tufting to achieve these slight shifts of the backing relative to stitch location by shifting the needle bar while the needles are within the fabric to move the fabric slightly and thereby increase the density. These needle-offset techniques have been known as "positive stitch placement" and "dual stitch placement", generally described in U.S. Pat. No. 4,630,558. It would be desirable to have a tufting machine that could utilize backing shifting relative to needle and gauge part positions, or vis-versa, in a fashion that was not constrained by the gauge of the needle bar.

In prior broadloom tufting there has been occasional implementation of "blocked needles" on graphics or double needle bar tufting machines. In some cases, this was the grouping of two adjacent needles on a first needle bar or row of needles, and a single needle (or two adjacent needles) on a second needle bar or row of needles. This arrangement would lead to the two yarns from adjacent needles in the first row always being planted through the backing fabric immediately adjacent, and that pair of yarns being separated by one or two yarns from the second row of needles, from the other yarns tufted by the first row. Such configurations are shown in Card, et al., U.S. Pat. No. 5,499,588 with the needles cooperating with two rows of loopers or with one row of loopers and one row of hooks and cutting knives.

Another example was the operation of graphics loop pile tufting machines by Wellco Carpets in creating patterns in its "Parquet" collection. The needle bars on these graphics machines had alternating blocks or segments of consecutive needles on the front and rear needle bars, extending for about one to two inches. So, in a one-inch block setting on fifth gauge needle bars, the front needle bar would have groups of five consecutive needles between needle positions 1-5, 11-15, 21-25, etc. . . . . The rear needle bar would have groups of five consecutive needles between needle positions 6-10, 16-20, 26-30, etc. . . . . The remaining needle positions were empty. Then as the carpet was tufted, nominally at five stitches per inch, the front needle bar would be operated in a "Positive Stitch Placement" mode according to U.S. Pat. No. 4,630,558 for five penetrations, which would slightly align the yarn tufts differently from stitches made on the rear needle bar that were sewn without Positive Stitch Placement shifting effects. In the second five penetrations, the front needle bar would be sewn without Positive Stitch Placement, and the rear needle bar would be sewn with those effects. The result was a carpet face with one-inch squares of slightly varied texture. The carpet was also made with two-inch squares, and could be made even using tenth gauge needle bars with alternating blocks of about 10-20 needles.

SUMMARY OF THE INVENTION

Accordingly, the present invention is directed to a backing shifter for use on broadloom tufting machine that is able to operate in a fashion that permits the shifting of the backing fabric relative to the needles and gauge parts without undo interference and thereby permits shifting not simply in gauge increments, but in a fashion that allows the creation of variable gauge and novel fabrics. The use of blocked needles, or alternating segments of consecutive needles on each of two needle bars allows the tufting machine to create different patterns and to tuft with less backstitch yarn and with only defined areas of over-tufting from front and rear needles.

BRIEF DESCRIPTION OF THE DRAWINGS

Particular features and advantages of the present invention will become apparent from the following description when considered in conjunction with the accompanying drawings in which.

DETAILED DESCRIPTION OF THE ILLUSTRATED EMBODIMENTS

Figure 1:
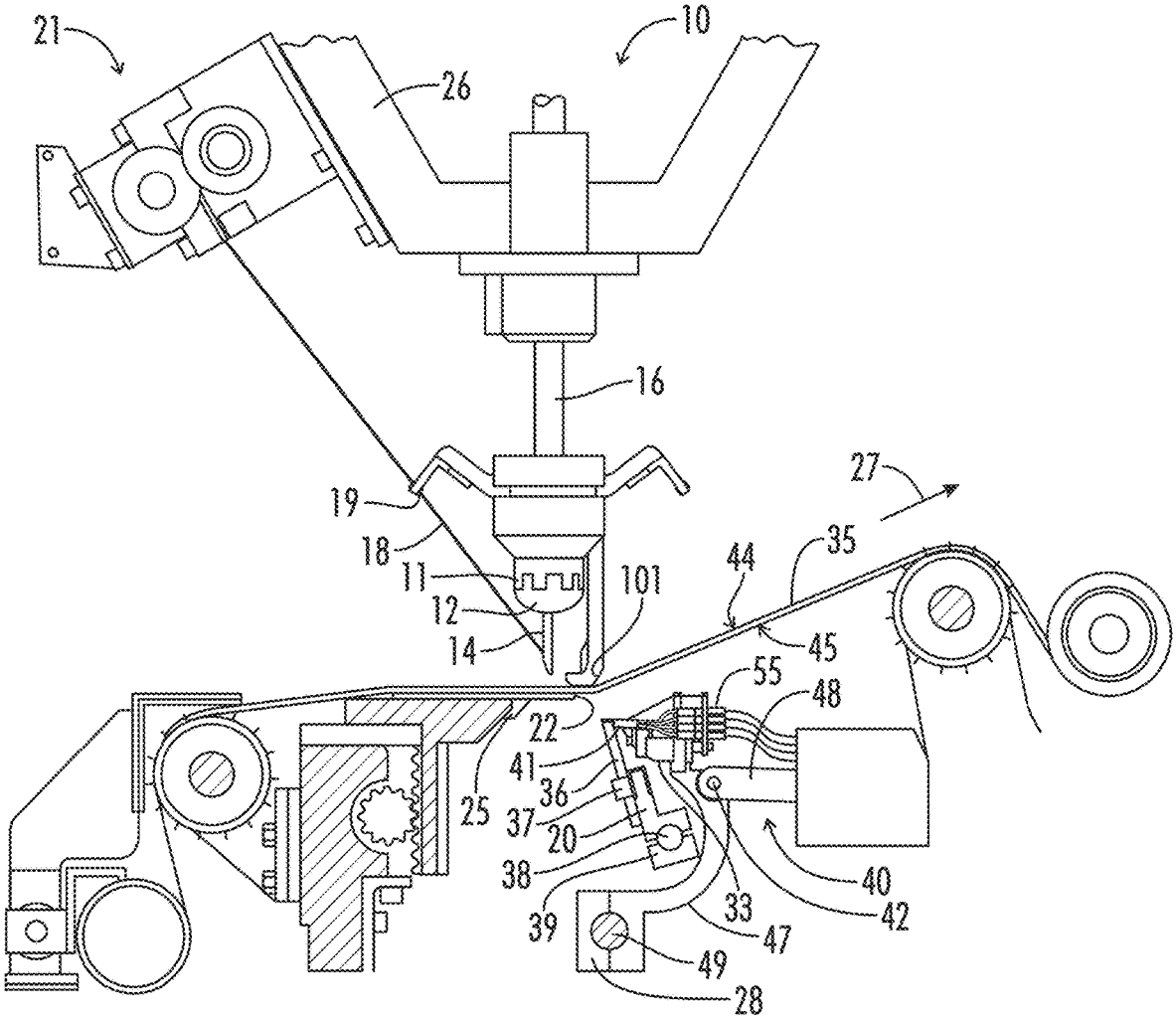
FIG. 1 (PRIOR ART)
FIG. 1 is a partial sectional end view of a prior art tufting machine with a single row of needles that can be operated to place yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21 though simpler yarn feed arrangements such a roll feeds may be employed. The yarn feed control 21 interfaces with a controller to feed yarns in accordance with pattern information and in synchronization with the needle drive, shifters, yarn seizing/cutting mechanisms and backing fabric feed.

The needle bar 12 may be fixedly mounted to the needle bar carrier 11 or may slide within the needle bar carrier 11 for transverse or lateral shifting movement by appropriate pattern control needle shifter mechanisms, in well-known manners. The backing fabric 35 is supported upon the needle plate 25 having rearward projecting transversely spaced front needle plate fingers 22, the fabric 35 being adopted for longitudinal movement from front-to-rear in a feeding direction, indicated by the arrow 27, through the tufting machine 10. The needle bar may have a single row of gauge spaced needles, as shown, or may be a staggered needle bar with front and rear rows of needles, or may even be two separate needle bars, each with a row of needles.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the back-stitch side 44 of backing fabric 35 to form loops on the face 45 thereof. After the loops are formed in this tufting zone, the needles 14 are vertically withdrawn to their elevated, retracted positions. A yarn seizing apparatus 40 in accordance with this illustration includes a plurality of gated hooks 41, there preferably being at least one gated hook 41 for each needle 14.

Each gated hook 41 is provided with a shank received in a corresponding slot in a hook bar 33 in a conventional manner. The gated hooks 41 may have the same transverse spacing or gauge as the needles 14 and are arranged so that the bill of a hook 41 is adapted to cross and engage with each corresponding needle 14 when the needle 14 is in its lower most position. Gated hooks 41 operate to seize the yarn 18 and form a loop therein when the sliding gate is closed by an associated pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 28 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. A preferred gated hook assembly is disclosed in U.S. Pat. No. 7,222,576 which is incorporated herein by reference.

It can be seen in FIG. 1 that the tufted greige 35 with backstitch side 44 and face side 45 is lifted away from the tufting zone after passing presser foot 101. When employing a backing shifter, it is necessary to move the face side 45 away from the hook apparatus of a cut pile or cut loop configuration as the lateral shifting of the backing could cause interference between the tufted yarns on the face 45 and the hooks 41. For the purposes of using the backing shifting apparatus of the present invention, it is preferable that the yarn seizing gauge parts be loopers that are disengaged from the loops of yarn after each stitch rather than hooks that often need to carry a yarn for one or more additional stitches to effect a cut pile.

Figure 2:
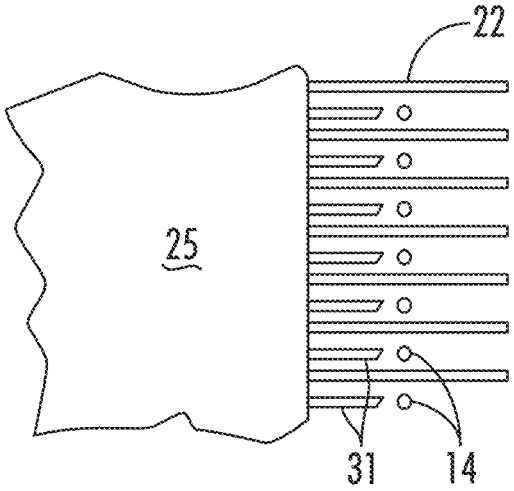
FIG. 2 is a top sectional view of a single row of needles and loopers that can be used in the manufacture of loop pile tufted fabrics.
Figure 4A:
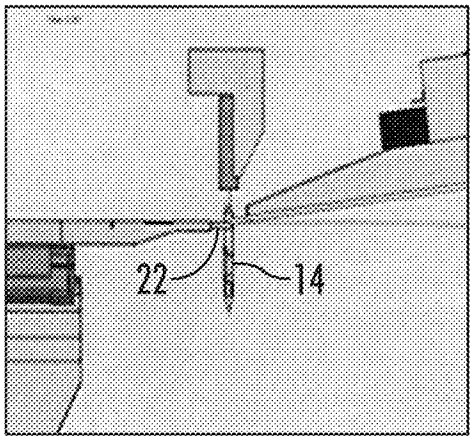
FIGS. 4A-4F are sequential side plan views of a tufting cycle corresponding to FIGS. 3A-3F.
Figure 3A:
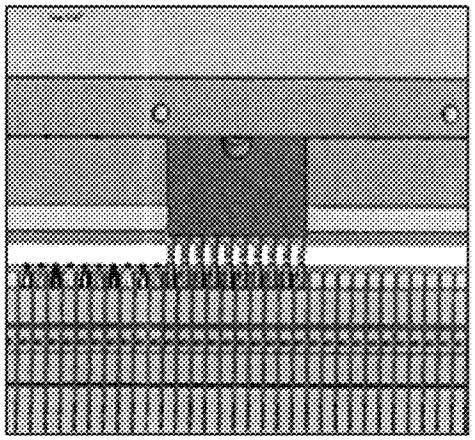
FIGS. 3A-3F are sequential front plan view of a tufting cycle of shifting backing feed and reciprocating needle plate through a tufting cycle.

FIG. 2 is a top view of a needle bar with a single row of needles 14 associated with loopers 31 and where a backing fabric, not shown, would pass over needle plate 25 and needle plate fingers 22 for tufting. The loopers 31 reciprocate in the forward direction when not seizing loops of yarn, in a fashion opposite to the movement of gated hooks 41 or cut pile hooks, and as a result tend to be away from the face side 45 of the tufted greige 35. This makes loopers 31 less likely to interfere with yarns tufted on the face of the greige when the backing is laterally shifted. Therefore, most implementations of the present invention more useful with loop pile configurations.

Figure 5A:
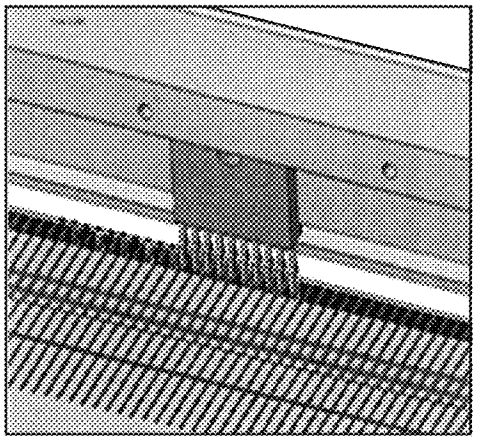
FIGS. 5A-5F are sequential front perspective views of a tufting cycle corresponding to FIGS. 3A-3F.
Figure 5B:
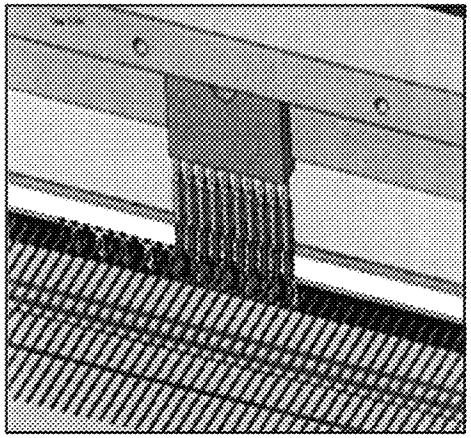
Figure 4B:
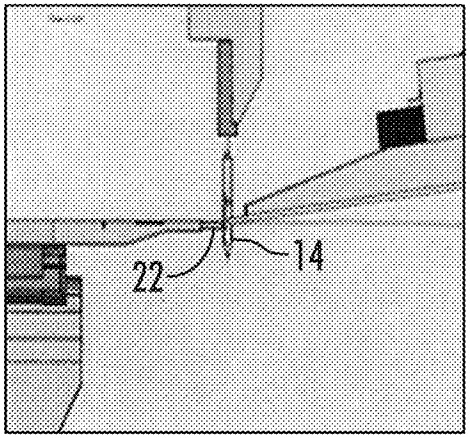
Figure 3B:
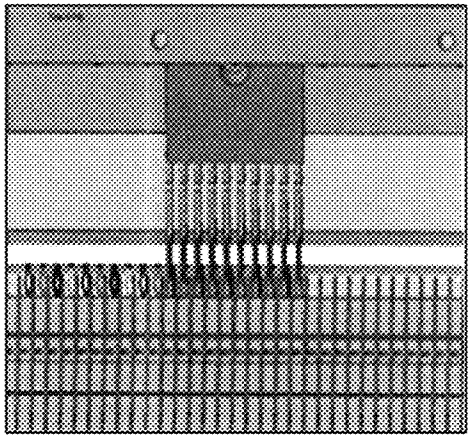
Figure 3C:
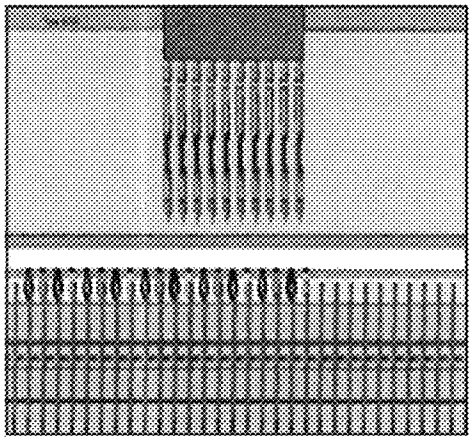
Figure 4C:
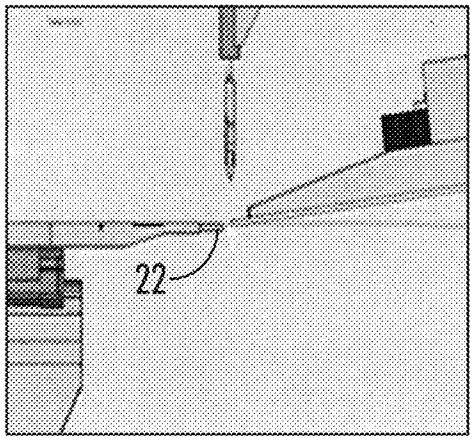
Figure 5C:
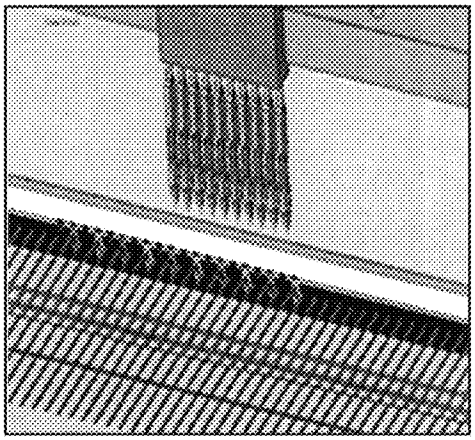
Figure 3D:
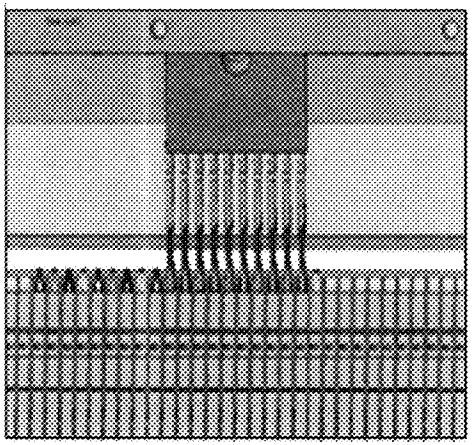
Figure 4D:
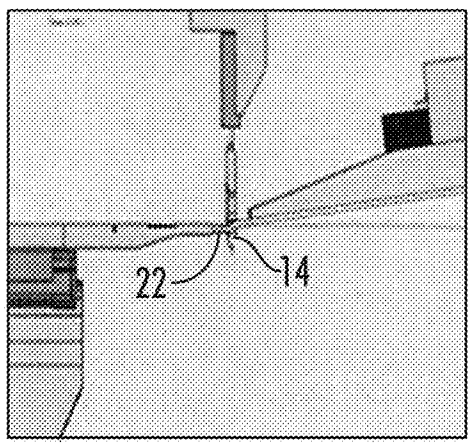
Figure 5D:
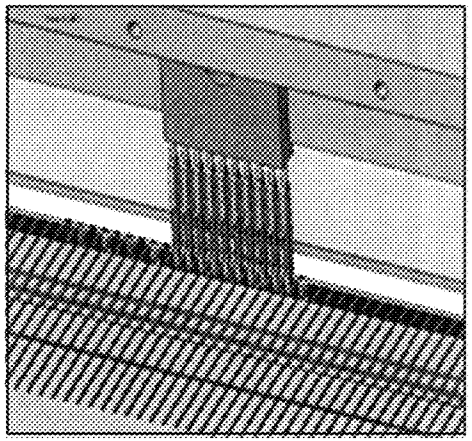
Figure 3E:
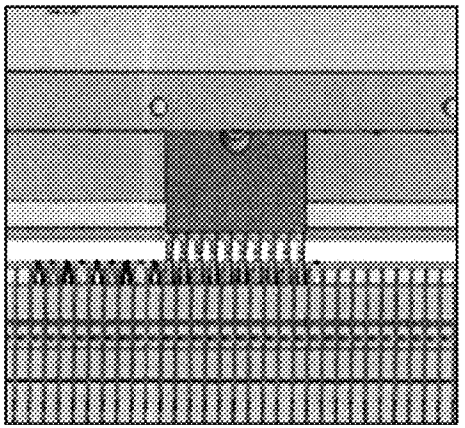
Figure 4E:
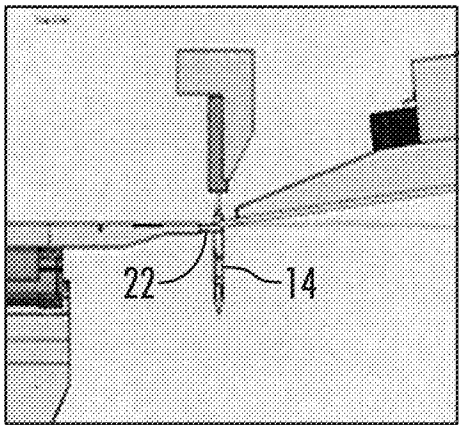
Figure 5E:
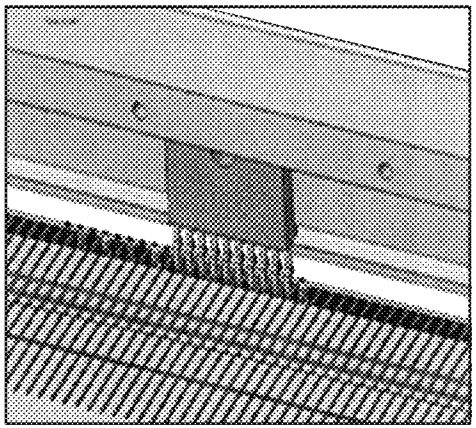
Figure 3F:
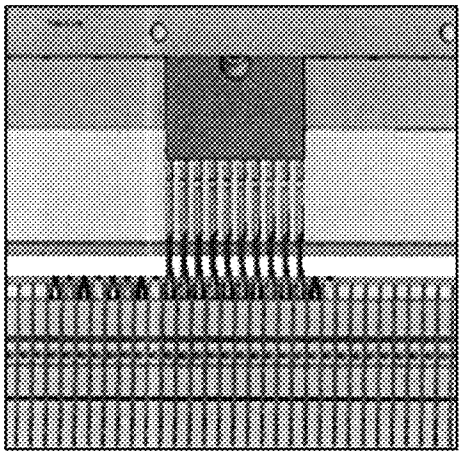
Figure 4F:
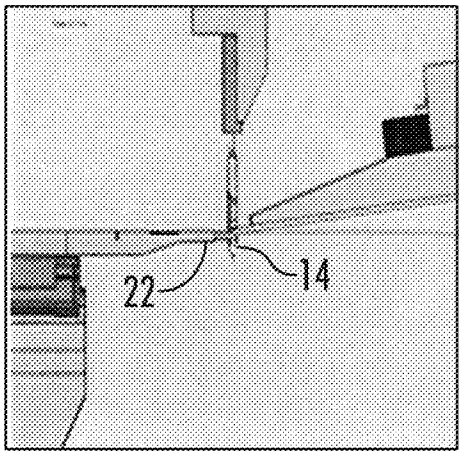
Figure 5F:
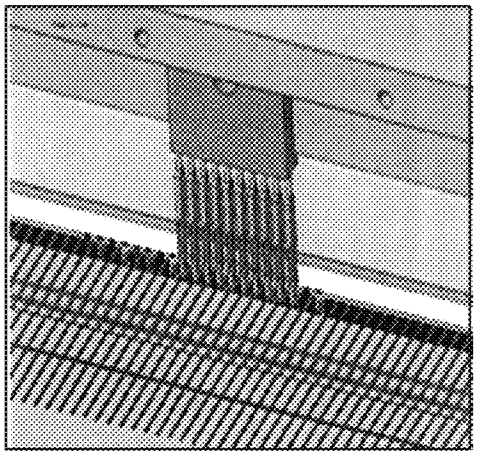

FIGS. 3A-F and corresponding views in FIGS. 4A-F and 5A-F illustrate the tufting zone movement of the needle plate fingers 22 in the new shiftable backing fabric design. It can be observed in FIGS. 3A, 4A, 5A that the needle plate finger 22 extends essentially to the presser foot and through much of the diameter of the needle 14 passing behind the needle plate finger. As the needle 14 moves upward retracting from the backing fabric, the needle plate finger 22 is similarly retracted away from the tufting zone toward the front of the tufting machine as shown in FIGS. 3B, 4B, 5B. In FIGS. 3C, 4C, 5C, the needle is free of the backing fabric and space exists between the needle plate fingers 22 and presser foot. As the needles 14 again move downward in FIGS. 3D, 4D, 5D, the needle plate fingers 22 move toward the tufting zone to support the backing fabric and remain in that position through the downward stroke as shown in FIGS. 3E, 4E, 5E but again begin to retract as needles 14 are removed from the backing fabric in FIGS. 3F, 4F, 5F.

Figure 6A:
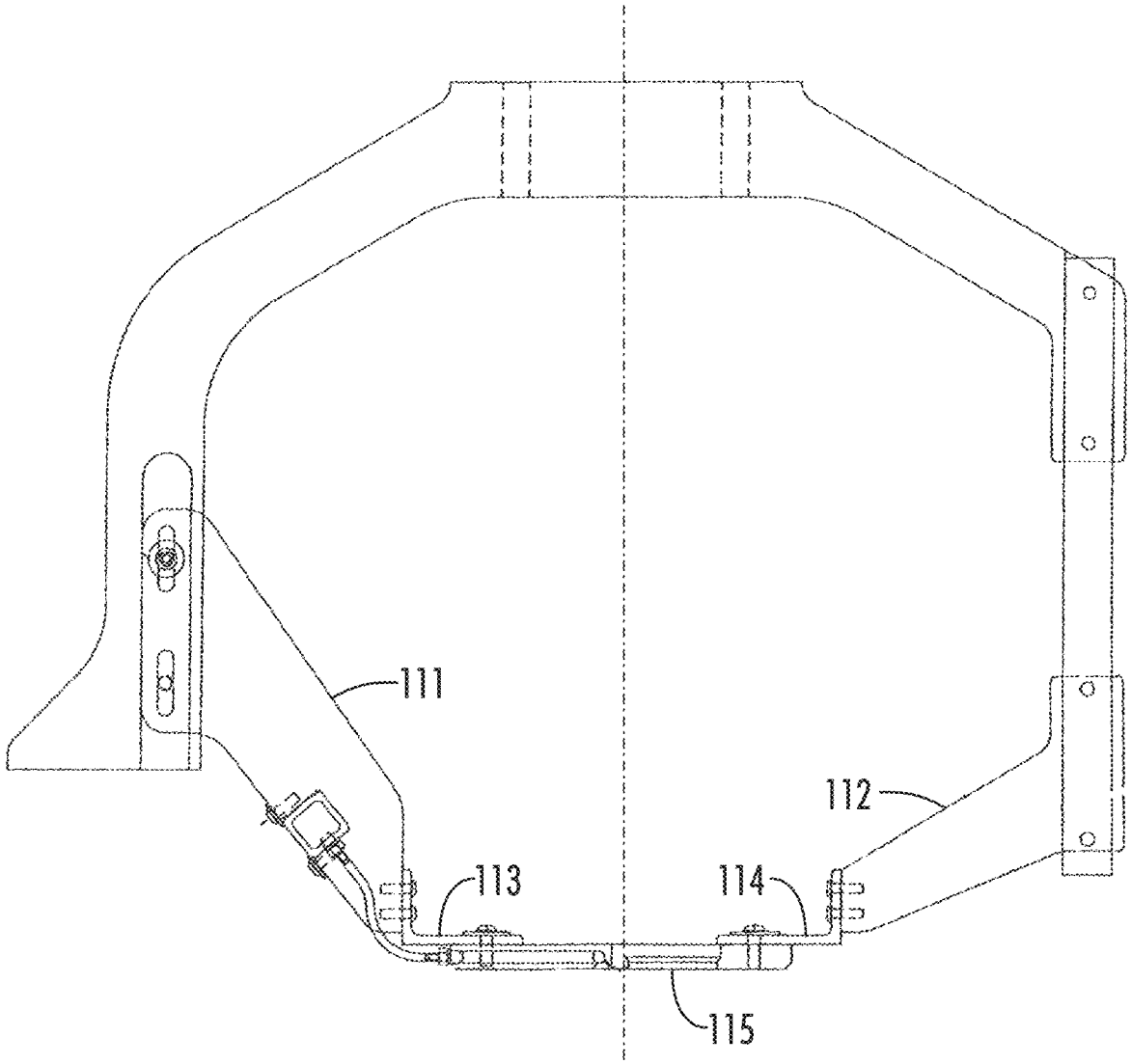
FIG. 6A (PRIOR ART)
FIG. 6A is a side plan view of a prior art presser foot assembly for backing shifter used on a hollow needle type tufting machine.
Figure 6B:
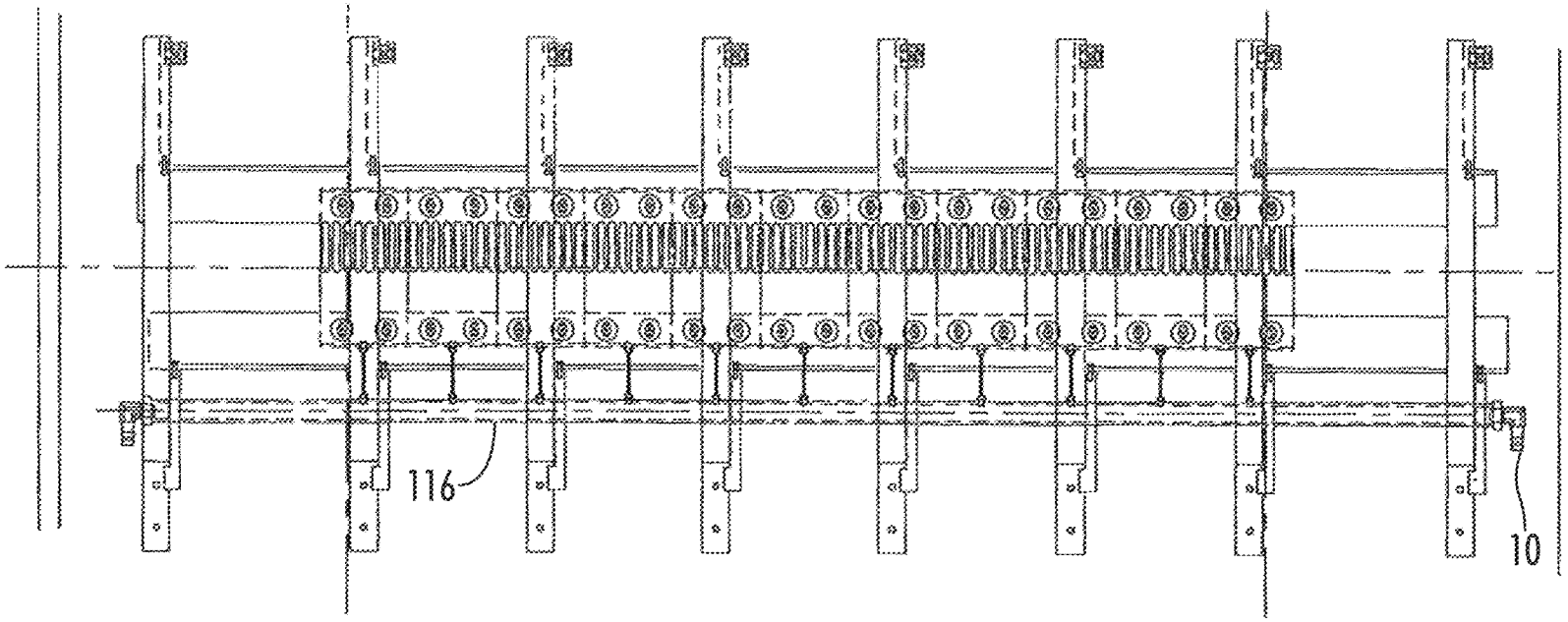
FIG. 6B (PRIOR ART)
FIG. 6B is a top plan view of the presser foot assembly illustrated in FIG. 6A.
Figure 7:
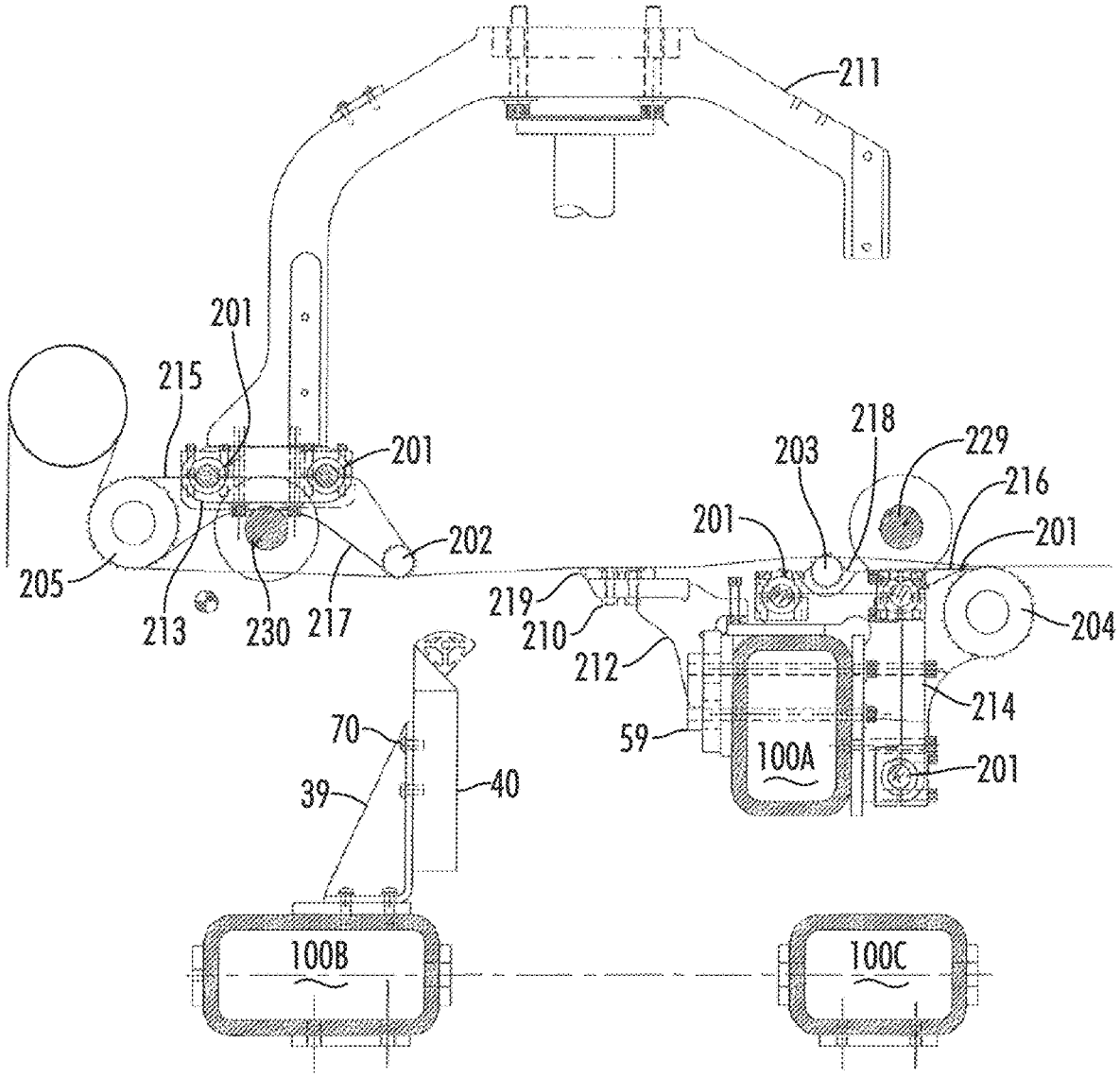
FIG. 7 (PRIOR ART)
FIG. 7 is a side sectional view of a prior art shiftable cloth feed assembly used on a hollow needle type tufting machine.

The reciprocating needle plate fingers of FIGS. 3-5 are suitable to be mounted in a slightly modified prior art backing shifting assembly such as that shown in FIGS. 6-9, with presser foot supports 111, 112 presser foot support angles 113, 114, presser foot plate 115, presser manifold 116. as shown in FIGS. 6A and 6B. FIG. 7 shows the prior art cloth feed assembly with bearing support bracket 211, bedplate rail 212, bearing housings 213, 214, three inch roll supports 215, 216, one inch roll supports 217, 218, support plate 219, nut bar 210, three inch tension rolls 204, 205, one inch pin rolls 202, 203, drive rods 229, 230, drive blocks 231, 232, and corner angle 39. Bearings 201 allow the roll supports 215-218 to move laterally with respect to the bearing support brackets 211 that are secured to the tufting machine. The needle plate 219 is replaced by a reciprocating needle plate as shown in FIGS. 10 and 11.

Figure 8B:
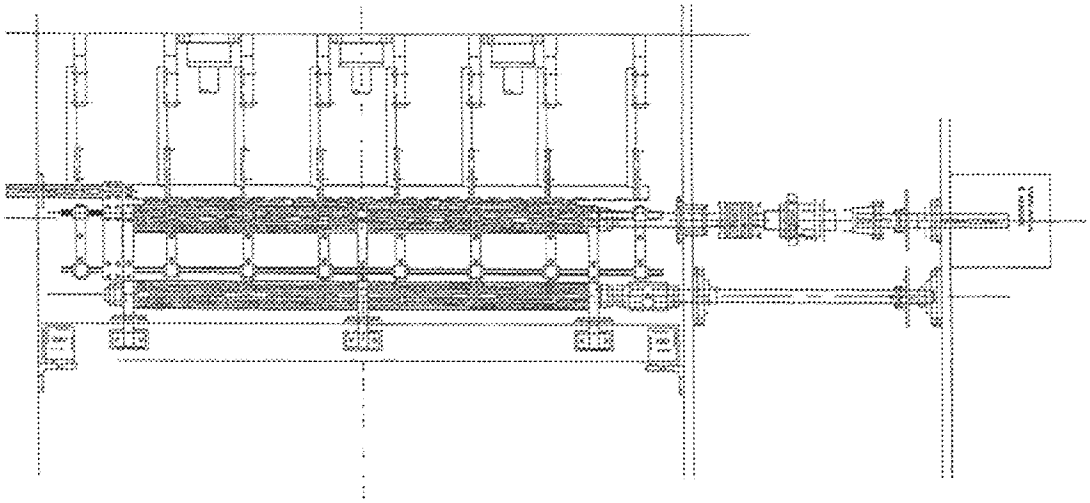
FIG. 8B is a front plan view of the tension roll assembly of FIG. 8A.
Figure 8A:
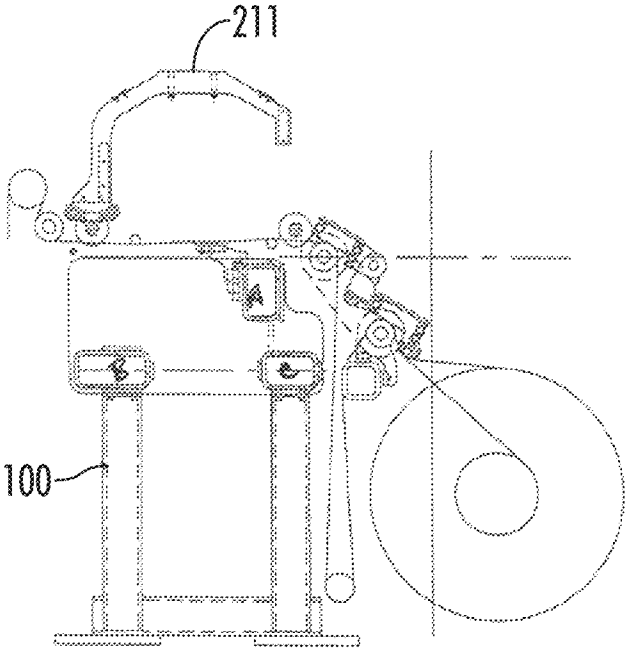
FIG. 8A is a side plan view of a prior art tension roll assembly used on a hollow needle type tufting machine.
Figure 9:
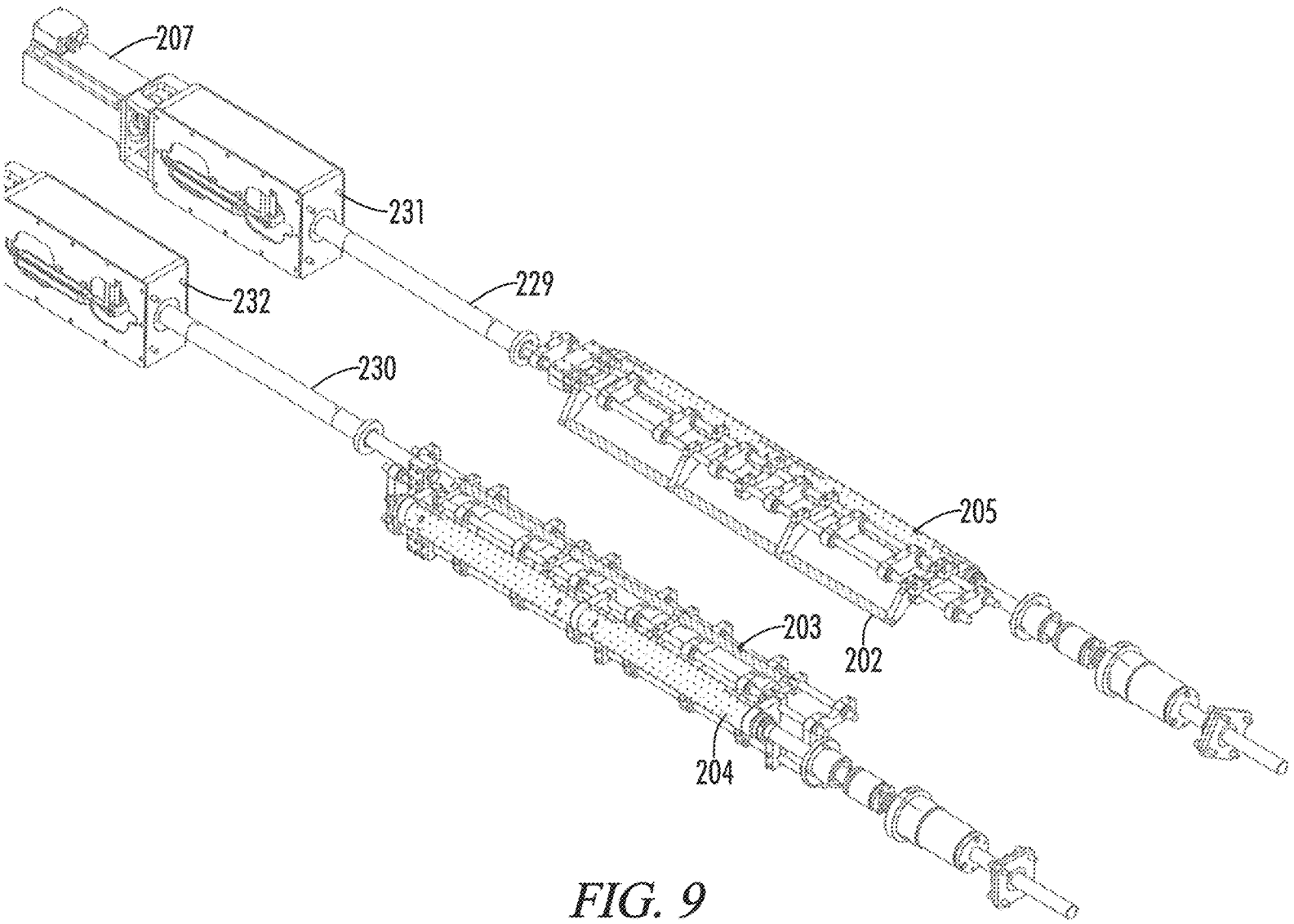
FIG. 9 (PRIOR ART)
FIG. 9 is a perspective view of a backing shifting apparatus in isolation.

FIGS. 8A and 8B show the tension roll assembly of FIG. 7 mounted on frame 100, and the three principal lateral frame beams 100A, 100B, 100C. FIG. 9 shows the shifting mechanism of that moves the entire cloth feed/backing feed assembly, including tension rolls, laterally with respect to the tufting machine. Linear drive motors 207 connect to drive blocks 231, 232 and thence to drive rods 229, 230 to communicate lateral movement to the tension roll assembly.

Figure 10A:
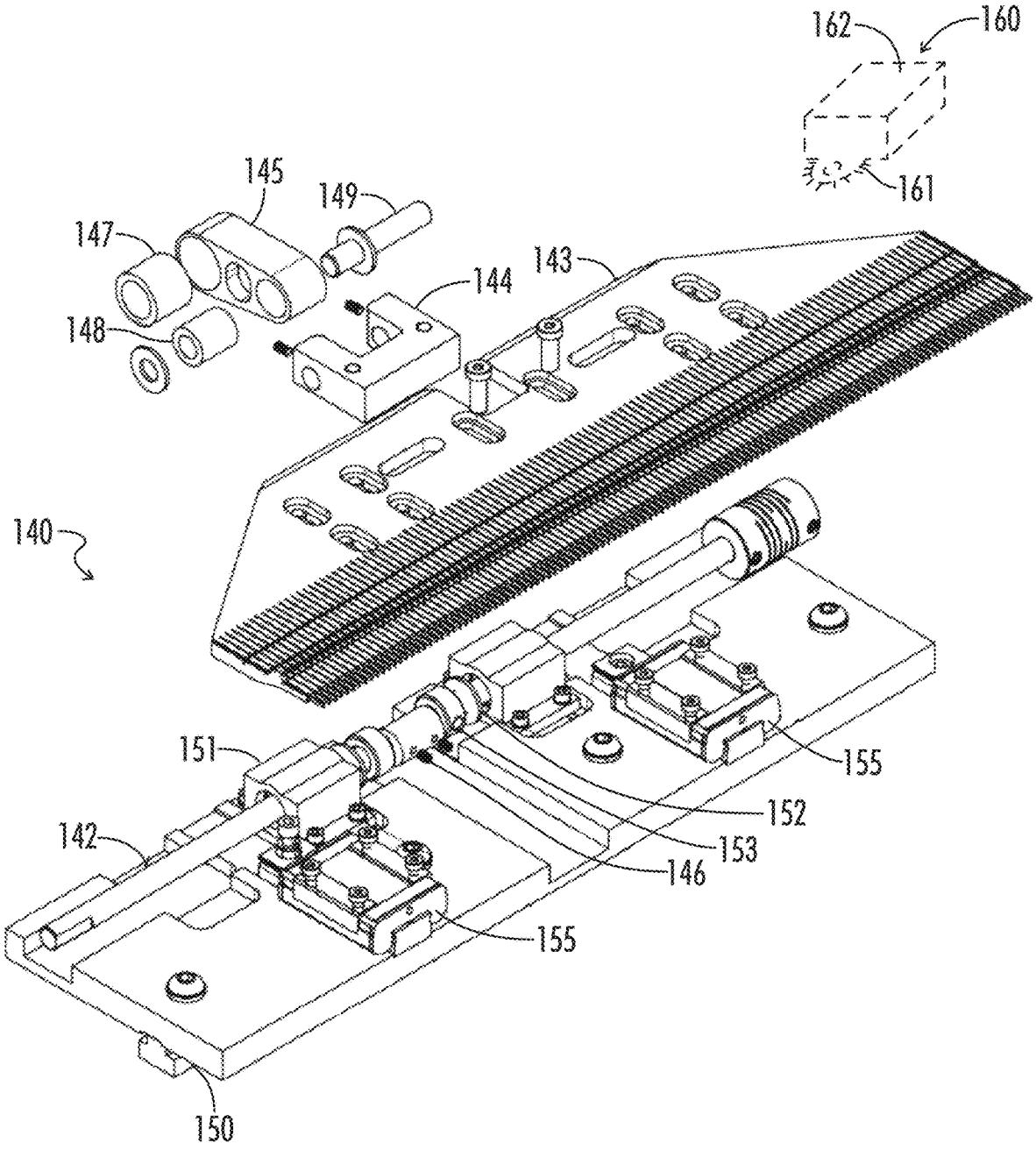
FIG. 10A is an exploded view of a section of an exemplary needle plate assembly.
Figure 11:
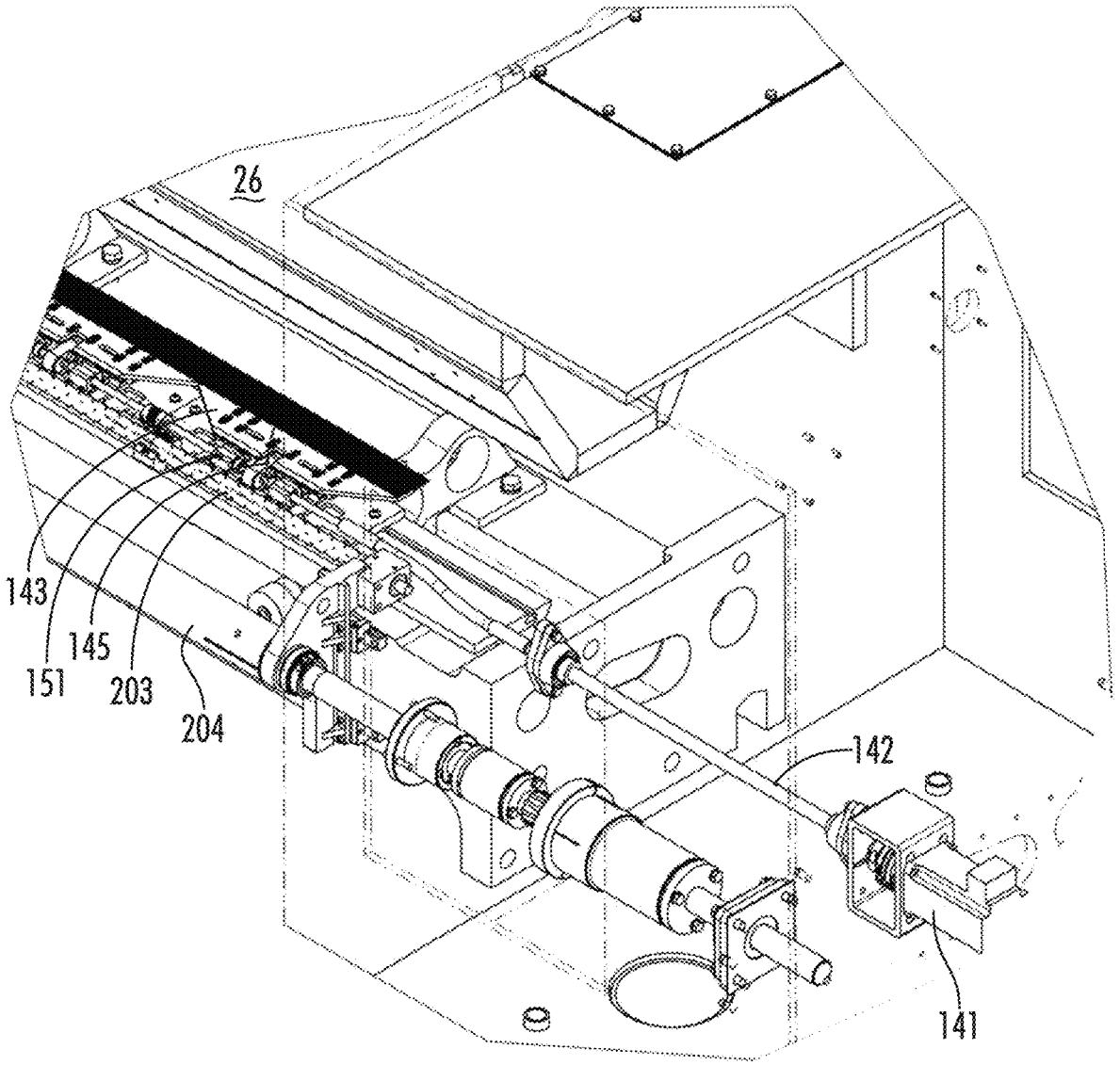
FIG. 11 is a partial sectional perspective view of an end of a tufting machine showing a servo motor drive for a reciprocating needle plate apparatus and equipped with a backing shifter.

Turning then to FIG. 10A, an exploded view of a reciprocating needle plate assembly 140 is shown. A base plate 150 secured to the tufting machine carries pillow blocks 151 with bearings to permit the rotation of shaft 142. Also, linear rail ball guides 155 are mounted to the base and the reciprocating needle plate 143 is mounted on those guides to control the longitudinal movement of the plate. The shaft 142 carries a cam 146 between collars 153 and thrust bearings 152 and pillow blocks 151. The cam 146 is set in a sleeve bearing 147 in one end of a connecting rod 145. The other end of the connecting rod 145 has a sleeve bearing 148 and is joined by a dowel 149 to wrist block 144 that is in turn fastened to the needle plate 143.

One feature that has proved helpful in maintaining the backing fabric in an unwrinkled state as it enters the tufting zone is the addition of temple roller assemblies 160 near each edge of the backing fabric. These assemblies contain temple rolls 161 that either by angular orientation as at pivots 162, or backing fabric engaging spike configuration, tend to keep the backing fabric stretched to its full width. Other tentering apparatus may also be used to the same effect.

Figure 10B:
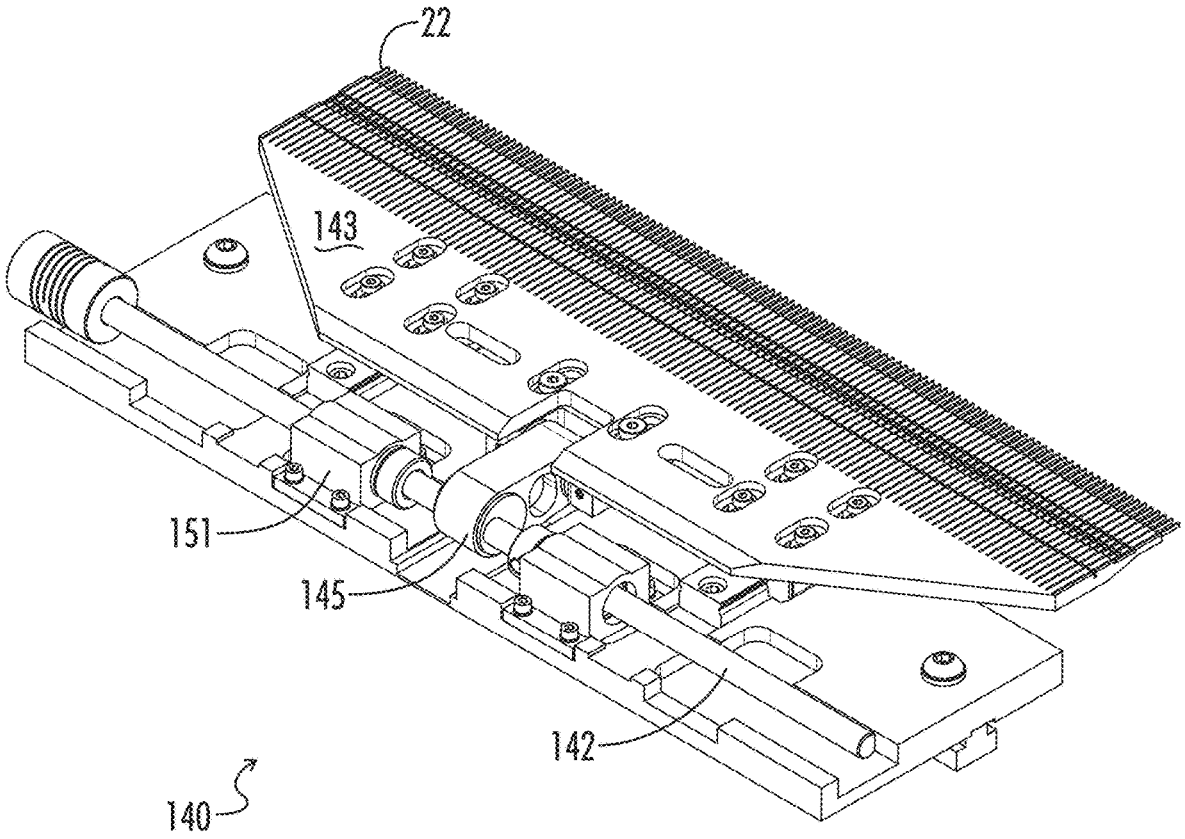
FIG. 10B is a perspective view of the reciprocating needle plate of FIG. 10A as put together for operation.

In FIG. 10B, it can be seen that the rotation of shaft 142 operates the cam 146 to effect movement of the connecting rod 145 and the linear rail ball guides direct the needle plate 143 with rearwardly projecting needle plate fingers 22 to reciprocate in a forward and rearward direction. This movement corresponds to the movement shown in FIGS. 3-5. As shown in FIG. 11, shaft 142 is rotated by servo drive 141 and this means of control allows for alterations to the timing, or reciprocation window, relative to the position of the needles in an independent and rapid fashion. Other techniques for driving reciprocating needle plates are possible such as by linkage with other driven systems such as the main drive motors or looper drive, the use of pneumatics, hydraulics, or linear drive motors.

Figure 12A:
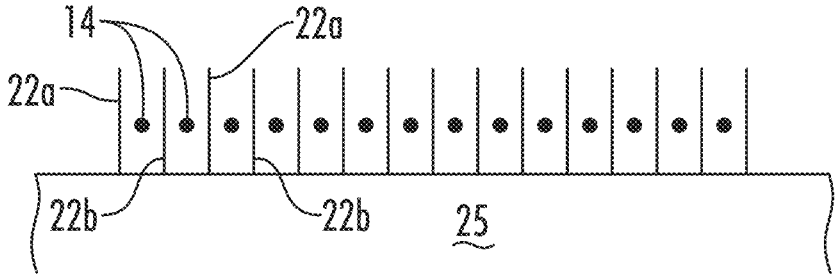
FIG. 12A is a top plan illustration of the needles and needle plate fingers of a reciprocating needle plate for a single row of needles.
Figure 12B:
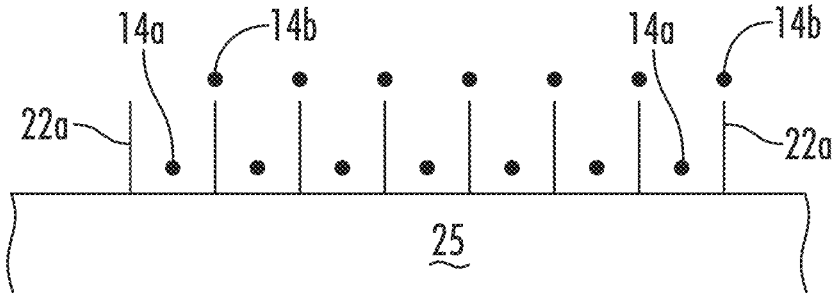
FIG. 12B is a top plan illustration of the location of the needles and needle plate fingers of a reciprocating needle plate for two rows of needles.
Figure 13A:
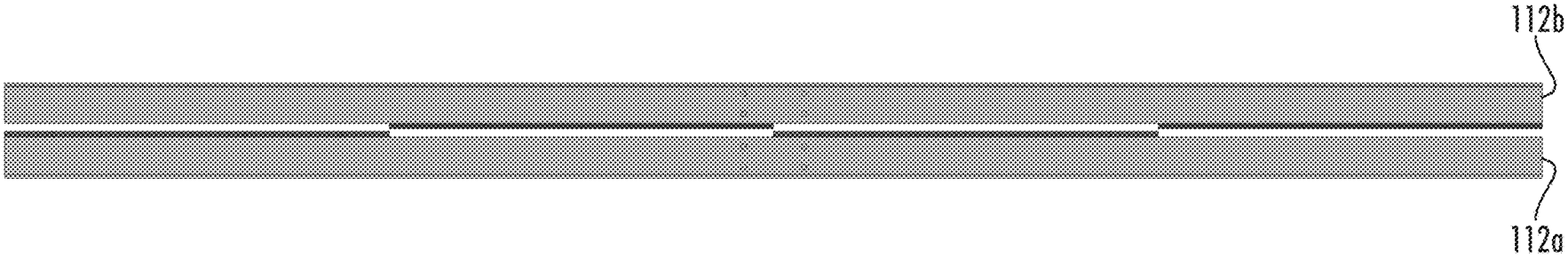
FIG. 13A is a top plan view of two shiftable needle bars configured with four alternating segments or blocks of needles.
Figure 13B:
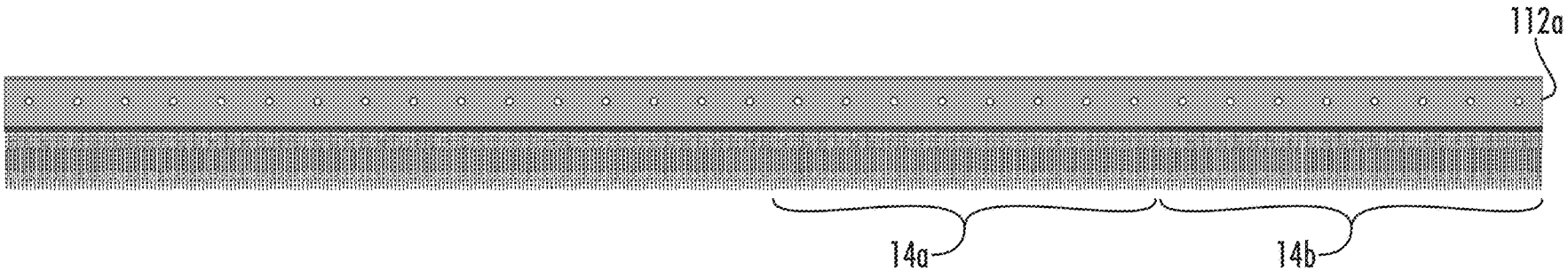
FIG. 13B is a rear elevation view of the needle bars of FIG. 13A.
Figure 13C:
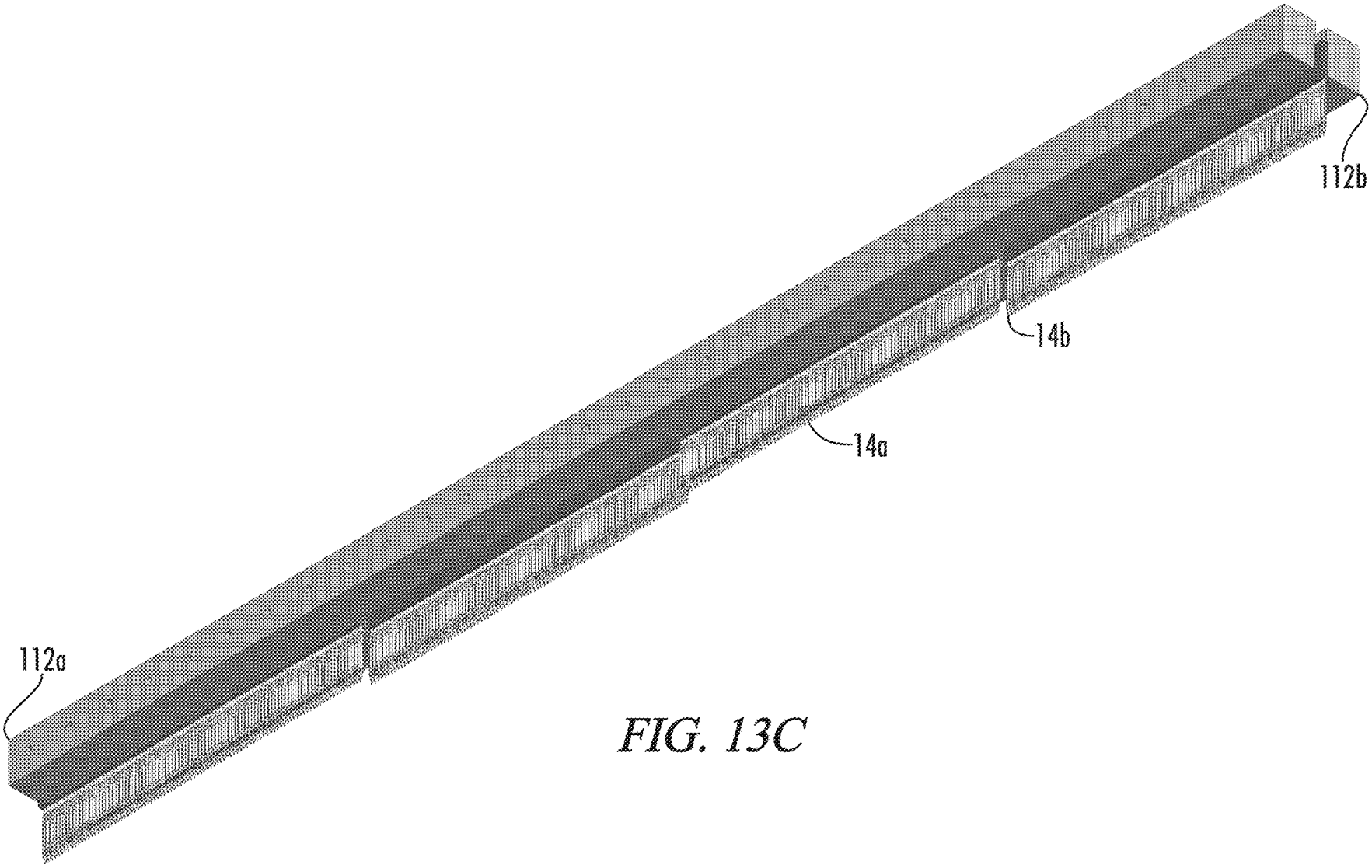
FIG. 13C is a bottom isometric view of the needle bars of FIG. 13A.

FIGS. 12A and 12B show the relative locations of needle plate fingers 22 and needles 14 in exemplary arrangements of one row of needles (FIG. 12A) and two rows of needles (FIG. 12B). When using a single row of needles 14 the needles are directly between needle plate fingers 22*a*, 22*b* at the time of penetrating the backing fabric. However, when two rows of needles are used, the front row of needles 14*a* are directly between needle plate fingers 22*a* at the time of penetrating the backing fabric. However, the rear row of needles 14*b* are located just beyond the ends of needle plate fingers 22*a*. Thus, the backing fabric near front needles 14*a* is supported by needle plate fingers 22*a* on either side, but the fabric near rear needles 14*b* is supported only by the end of the adjacent needle plate finger 22*a*. To improve the fabric support, in either case, it is sometimes helpful to place a riser beneath the face of the tufted greige to lift the tufted fabric upward as soon after the presser bar as practicable.

Advantageously, and different from prior usage in broadloom tufting machines, the backing assembly can be precisely shifted for substantial distances, typically on the order of 1 to 2.5 inches in each direction from center. This provides tufting machine with great versatility and allows a quarter gauge tufting machine to simulate an $\frac{1}{8}^{th}$ gauge tufting machine and provides numerous patterning advantages. Furthermore, an $\frac{1}{8}^{th}$ gauge tufting machine can very nearly imitate a $\frac{1}{10}^{th}$ gauge tufting machine, although not all stitches will appear in perfectly aligned rows. By way of example, a $\frac{1}{8}^{th}$ gauge machine will most commonly tuft at a stitch rate of about 8 stitches per inch, thereby placing 64 stitches in a square inch of backing. A $\frac{1}{10}^{th}$ gauge machine will most commonly tuft at about 10 stitches per inch with a resulting 100 stitches being placed in a square inch of backing. However, by increasing the stitch rate of a $1/8^{th}$ gauge tufting machine equipped with backing shifter and reciprocating needle plate to 12.5 stitches per inch, a stitch density of 100 stitches per square inch. In cases where the stich rate is being increased by a multiple of the gauge of the backing shifter and reciprocating needle plate equipped machine, there may be a perfect pattern alignment. In other cases, the stitches may not align in exact longitudinal rows.

The failure to align in exact longitudinal rows may be perceived as an advantage in some tufting applications. For instance, solid color shifting is used when manufacturing solid color carpets to break up any streaks or irregularities in the yarns that might otherwise be noticeable. Residential solid color carpets are sometimes sewn on 5/32nds or $3/16^{th}$ inch gauge staggered needle bars with two rows of needles. These needle bars require shifts of 0.375 or 0.3125 inches for the streak break-up shifting. With a backing shifter and reciprocating needle plate equipped tufting machine, shifts of as little as 0.10 inches, and perhaps 0.05 inches, could be employed. The smaller shifts permit greater machine speed and require less lateral yarn on the backstitches that is effectively lost to effective use.

Figure 14:
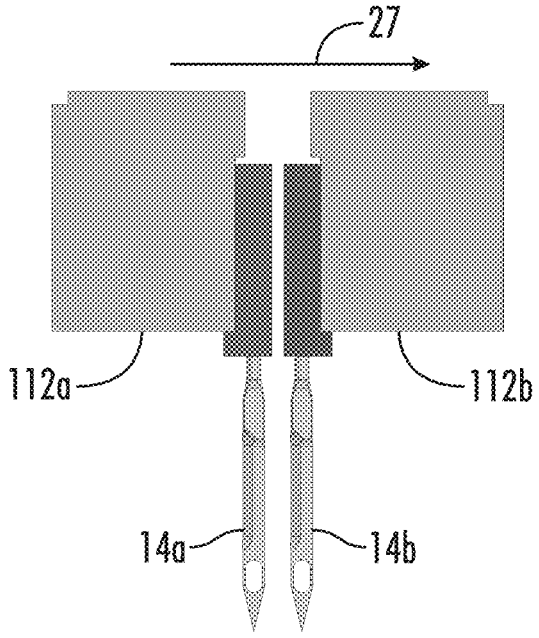
FIG. 14 is an end elevation view of two shiftable needle bars such as those shown in FIGS. 13 and 18.
Figure 15A:
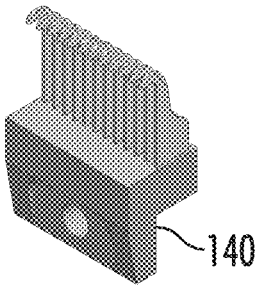
FIG. 15A shows a top isometric view of a looper block with loopers configured to engage with yarns carried on a first row of needles.
Figure 16A:
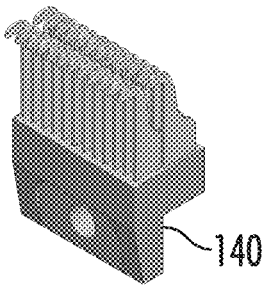
FIG. 16A shows a top isometric view of a looper block with loopers configured to engage with yarns carried on both first and second rows of needles.
Figure 17A:
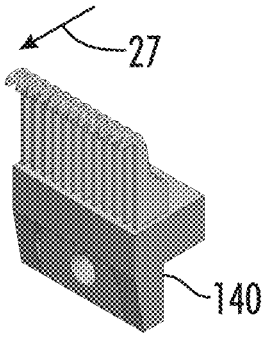
FIG. 17A shows a top isometric view of a looper block with loopers configured to engage with yarns carried on a second row of needles.
Figure 15B:
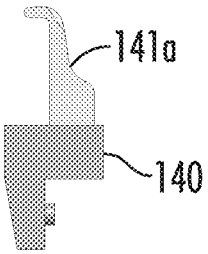
FIG. 15B is an end elevation view of the looper block of FIG. 15A.
Figure 16B:
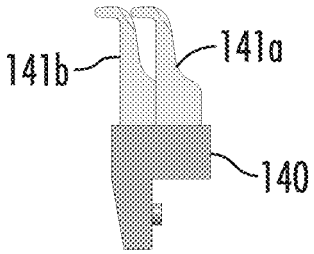
FIG. 16B is an end elevation view of the looper block of FIG. 16A.
Figure 17B:
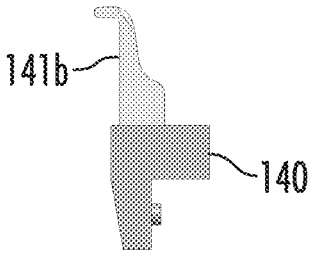
FIG. 17B is an end elevation view of the looper block of FIG. 17A.

In FIGS. 13-18, the needles in the front row are designated 14*a* and the needles in the rear row are designated 14*b*. The front needle bar 112*a* carries two "blocks" or segments of consecutively spaced front needles 14*a*. The rear needle bar 112*b* carries two blocks of consecutively spaced rear needles 14*b*. FIG. 14 shows the backing fabric feed direction 27 with the backing passing first by front needles 14*a* and then rear needles 14*b*. The yarn loop seizing system 140 shown in FIGS. 15-17 comprises conventional loopers that can be operated on a rocker bar in synchronization with penetrations of the needles 14*a*, 14*b* to seize loops of yarn carried on the needles through the backing fabric. Front loopers 141*a* are positioned forward as in FIG. 15A to cooperate with front needles 14*a* and rear loopers 141*b* are positioned rearward as in FIG. 17A to cooperate with rear needles 14*b*. In the zones where needles from both front and rear needle bar segments may penetrate the backing carrying yarns, FIGS. 16A and 16B show how front and rear loopers 141*a*, 141*b* may be carried to cooperate with needles in either row. In many cases these overlap zones between needles from both front and rear needle bar blocks will be only about 1 to 5 gauge units, so that the looper block shown in FIG. 16A might have several rear loopers 141*b* removed from its left side and several front loopers 141*a* removed from its right side, if it were positioned between the looper blocks shown in FIGS. 15A and 17A on a looper rocker bar.

Figure 18A:
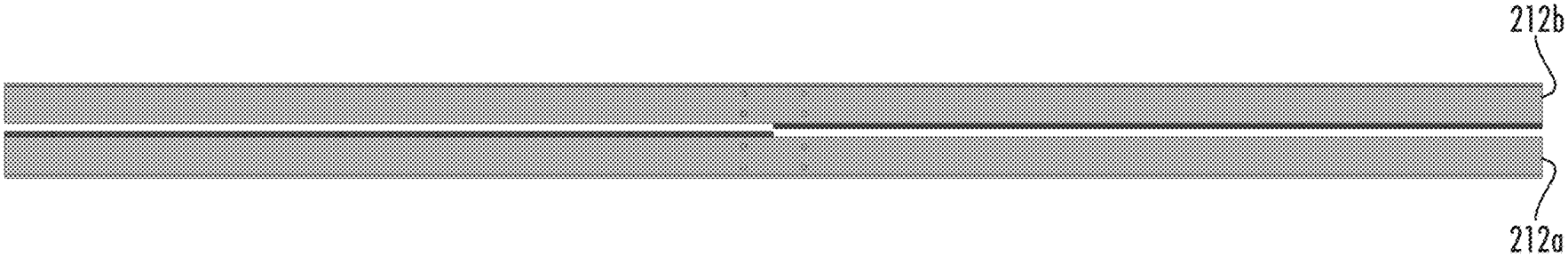
FIG. 18A is a top plan view of two shiftable needle bars configured with two alternating segments of needles.
Figure 18B:
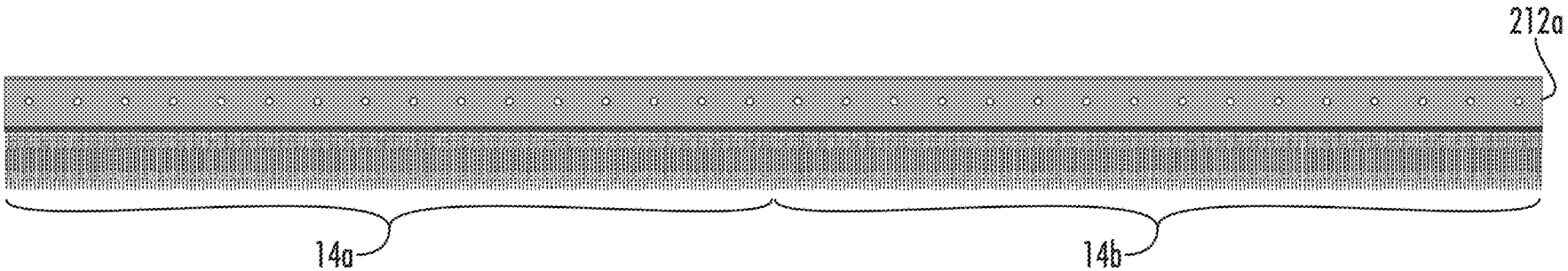
FIG. 18B is a rear elevation view of the needle bars of FIG. 18A.
Figure 18C:
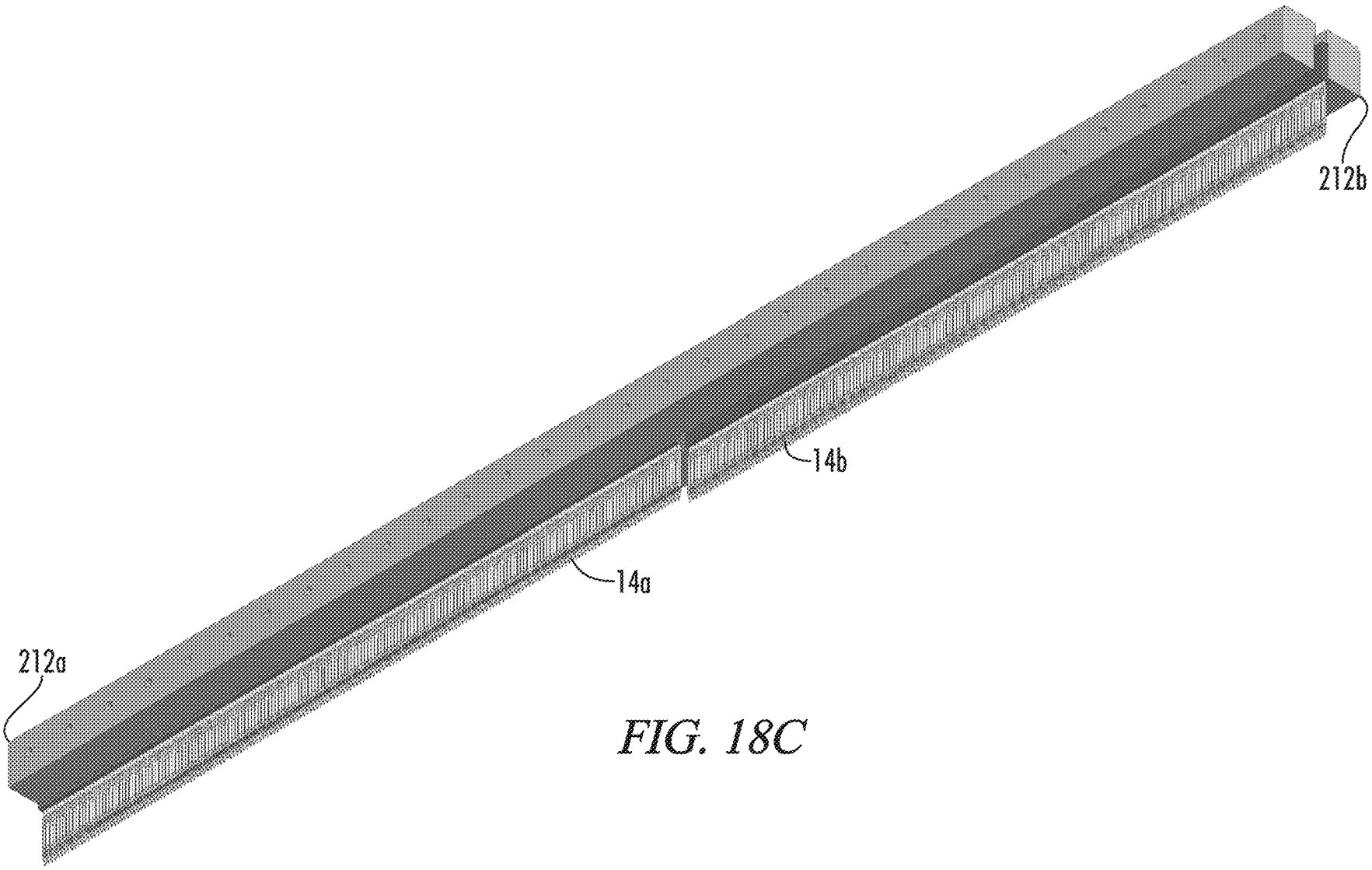
FIG. 18C is a bottom isometric view of the needle bars of FIG. 18A.

FIGS. 18A-C illustrate another segmented needle bar configuration where half the needles of a tufting machine are mounted consecutively as a block as front needles 14*a* on the right hand side of front needle bar 212*a*, and the other half of the needles are mounted consecutively as a block as rear needles 14*b* on the left hand side of rear needle bar 212*b*. In this configuration, in a 16-foot-wide broadloom tufting machine with $1/10^{th}$ gauge needle spacing, there might be 800 front needles 14*a* forming a single eight-foot-wide segment. The front and rear needles 14*a*, 14*b* could be operated to sew entirely separate six-foot-wide fabrics for use as rugs or in carpet tiles, or with the combined looper blocks of FIGS. 16A and 16B can cooperatively sew a 16-foot-wide fabric. When sewing separate fabrics, the looper blocks having the double looper configuration of FIGS. 16A and 16B may not even be required. Needle bars with groups of "blocked" needles can be utilized in the yarn color placement systems of Hall, U.S. Pat. No. 8,776,703, or Frost, U.S. Pat. No. 9,556,548, and their related patents, all of which are incorporated herein by reference.

Smaller segments of needles can be used to create various checkerboard or parquet effects in the fabric, and the capability of shifting of the backing and each or the front and rear needles independently allows for even three inch wide blocks, or perhaps 30 consecutively spaced $1/10^{th}$ gauge needles in alternating front and rear segments. In these highly varied patterning setups, the double looper configuration of FIGS. 16A and 16B may be required across the entire width of the tufting machine. For more limited design effects, where the positions of the yarns stay within several gauge positions for the entire pattern, consecutive needle segments of virtually any size are possible. Widths of about one, two and three feet, comprising segments of anywhere from about 60 to 500 needles, depending upon the exact width and gauge, all present interesting graphical choices.

A configuration of particular interest employs a front needle bar of relatively narrower gauge consecutive needle placement in a central segment, in combination with a rear needle bar of relatively broader gauge with needle segments disposed at the ends for the purpose of tufting carpet with different edge characteristics. For instance, in the manufacture of rugs, it has been known to utilize auxiliary yarn feeds to tuft side borders as described in U.S. Pat. No. 5,544,605. By utilizing for instance a front needle bar with $1/10^{th}$ gauge needle spacing in a central segment and rear needle bar with needles located in approximately six to twelve inch segments at the extreme right and extreme left of the width of the tufting machine and $1/5^{th}$ gauge needle spacing, the rear needle bar can be threaded with different yarns or yarn sequences and shifted differently than the front needle bar with its central segment of tighter spaced needles to optimize tufting of carpet with distinct border sections.

Figure 19A:
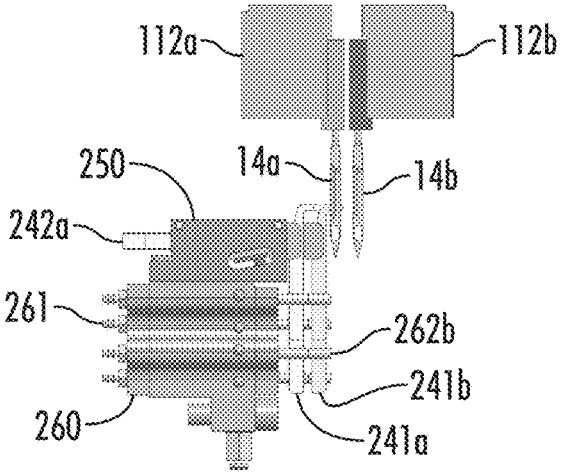
FIG. 19A is a side elevation view of the needle bars of FIG. 18 with extensible loopers shown in the needles down and loopers retracted position.
Figure 19B:
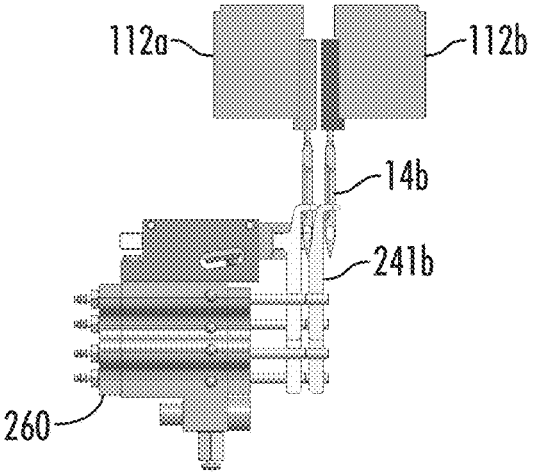
FIG. 19B illustrates the needles and loopers of FIG. 19A with the extensible loopers in extended position.
Figure 20A:
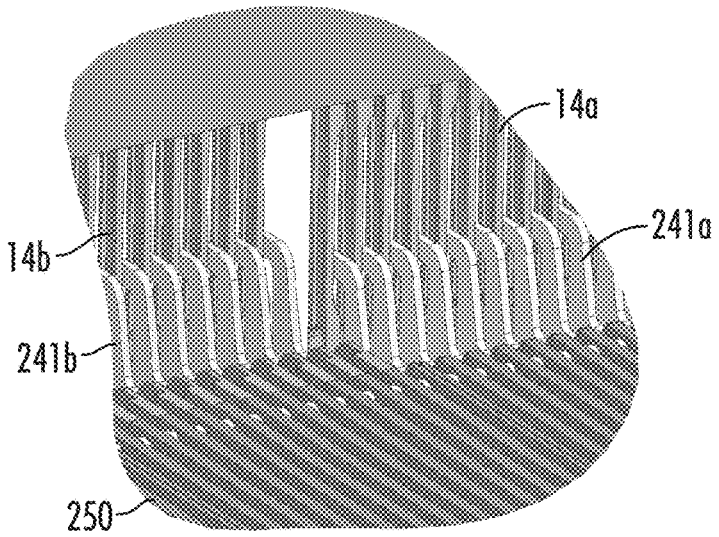
FIG. 20A is an enlarged perspective view of the needles and loopers of FIG. 19B.
Figure 20B:
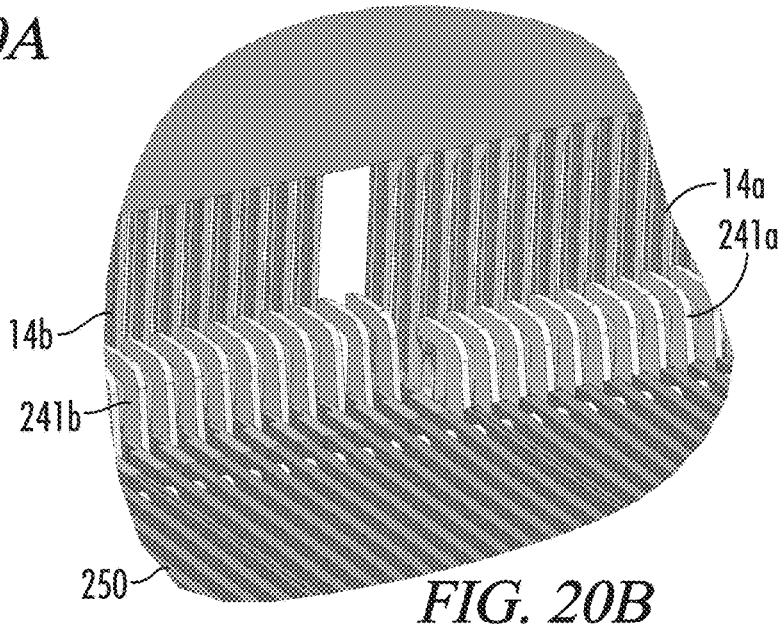
FIG. 20B is an enlarged perspective view of the needles and loopers of FIG. 19A.
Figure 21:
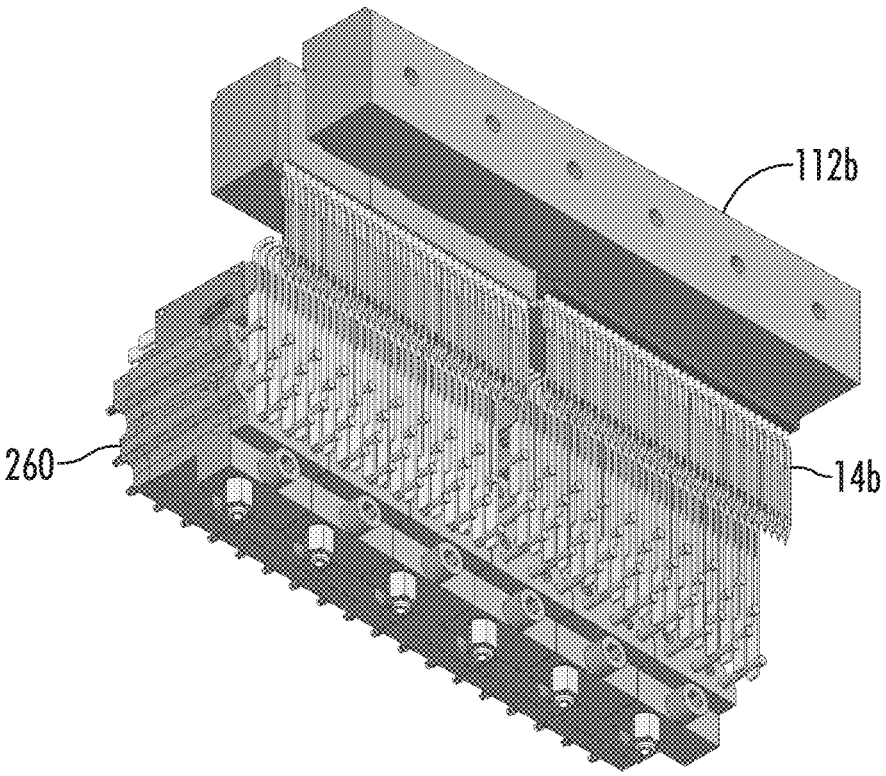
FIG. 21 is a bottom rear perspective view of the needles and loopers of FIG. 18A.

Another configuration of interest is shown in FIGS. 19-21 where segmented needle bar with front needles 14*a* and rear needles 14*b* is shown in connection with an array of extensible loopers 241*a*, 241*b*. As illustrated, the extensible loopers 241*a*, 241*b* have stabilizing rear protrusions such as 242*a* passing through guide blocks 250 and driven by pneumatic cylinders mounted in cylinder block 260 where pressurized air may enter through fittings 261 to drive actuators such as 262*b* and move the corresponding looper 241*b* into engagement with yarns carried on needles 14*a*, 14*b*. Front loopers 241*a* will engage with yarns carried by front needles 14*a* and rear loopers 241*b* will engage with yarns carried by rear needles 14*b* when loopers are extended during the downward portion of the needle stroke through the backing fabric. As the needle segments from front and rear needle bars may cross of overlap as a result of shifting, the needle bars 112*a*, 112*b* the rear loopers 241*b* can be operated to not only seize yarns from rear needles 14*b*, but alternatively to seize yarns from front needles 14*a*.

This provides the option of seizing or not seizing loops of yarn from the needles, or alternatively seizing loops of yarn from the front needle bar that are subsequently withdrawn by back-robbing. The use of extensible loopers with segmented needle bars provides even greater patterning versatility and precision.

It can be seen that the use of blocks of needles, on either a single needle bar (as by re-arranging the needles from a traditional staggered configuration), or on two independently shiftable needle bars as illustrated, provides a tufting machine with diverse patterning and manufacturing capabilities. A variable gauge tufting machine could be configured to make $1/10^{th}$ gauge fabric (or other gauges) with conventional front and rear $1/5^{th}$ gauge needle bars, or with segmented $1/10^{th}$ gauge needle bars. The use of segmented needle bars provides for different yarn placement strategies and may reduce backstitch yarn by reducing the gauge distance of lateral shifts of the needle bar, and may minimize zones where yarns from the rear needles 14*b* rear needle bar 112*b* would overtuft yarns previously tufted by front needles 14*a*.

Numerous alterations of the structure herein described will suggest themselves to those skilled in the art. It will be understood that the details and arrangements of the parts that have been described and illustrated in order to explain the nature of the invention are not to be construed as any limitation of the invention. All such alterations which do not depart from the spirit of the invention are intended to be included within the scope of the appended claims.

What is claimed is:

1. A tufting machine for forming tufted fabrics, comprising:

at least one needle bar having a series of gauge spaced needles mounted transversely across the width of the tufting machine;

the transverse series of gauge spaced needles occupying forward and rear positions, with at least a plurality of consecutively spaced needles being in forward positions and another plurality of consecutively spaced needles being in rear positions;

backing feed rolls for feeding a backing material through a tufting zone of the tufting machine from front to back;

a backing shifter for transversely shifting the backing material relative to the needles in the tufting zone;

a yarn feed mechanism for feeding a series of yarns to said needles;

a series of gauge parts mounted below the tufting zone in a position to engage needles of said at least one needle bar as the needles are reciprocated into the backing material to seize yarns from needles and form tufts of yarns in the backing material;

a control system for controlling and synchronizing the needle drive and backing feed.

2. The tufting machine of claim 1 wherein the at least one needle bar comprises a front needle bar carrying gauge spaced needles occupying forward positions, and a rear needle bar carrying gauge spaced needles occupying rear positions.

3. The tufting machine of claim 1 further comprising a needle plate with reward extending needle plate fingers and the series of needles pass between the needle plate fingers when reciprocated into the backing material.

4. The tufting machine of claim 1 wherein the series of needles comprises a first front row of transversely spaced needles and a second rear row of transversely spaced needles.

5. The tufting machine of claim 4 wherein the needle plate has reward extending needle plate fingers and the first front row of needles pass between the needle plate fingers when reciprocated into the backing material.

6. The tufting machine of claim 5 wherein the second rear row of needles pass immediately rearward of rear ends of the needle plate fingers when reciprocated into the backing material.

7. The tufting machine of claim 1 wherein the gauge parts are loopers.

8. The tufting machine of claim 7 wherein a plurality of the loopers are extensible to selectively seize yarns from needles in forward positions or needles in rearward positions.

9. The tufting machine of claim 7 wherein a plurality of the loopers are selectively extensible to seize yarns from selected needles.

10. The tufting machine of claim 1 wherein the series of needles is spaced transversely in a row having a gauge of $5/16$ths, $1/5^{th}$, $1/6^{th}$, $1/8^{th}$, $1/10$, $6/16$ths, $10/32$nds or $1/12^{th}$ inches.

11. The tufting machine of claim 1 wherein the backing shifter is operable by the control system to shift the backing rolls transversely at least one inch from center position.

12. The tufting machine of claim 1 comprising a second needle bar having a series of needles mounted transversely across the width of the tufting machine positioned rear of the first needle bar.

13. A tufting machine for forming tufted fabrics, comprising:

a front needle bar having a series of gauge spaced needles mounted transversely across the width of the tufting machine, with a segment of at least three consecutively spaced needles and a segment without needles;

a rear needle bar having a series of gauge spaced needles mounted transversely across the width of the tufting machine with a segment of at least three consecutively spaced needles that are longitudinally aligned with the segment of the front needle bar without needles;

backing feed rolls for feeding a backing material through a tufting zone of the tufting machine from front to back;

at least one shifter for transversely shifting the relative position of at least one plurality of consecutively spaced needles and the backing fabric in the tufting zone;

a yarn feed mechanism for feeding a series of yarns to said needles;

a series of gauge parts mounted below the tufting zone in a position to engage needles of said at least one needle bar as the needles are reciprocated into the backing material to seize yarns from needles and form tufts of yarns in the backing material;

a control system for controlling and synchronizing the needle drive and backing feed.

14. The tufting machine of claim 13 wherein the gauge of the at least three consecutively spaced needles on the front needle bar is different from the gauge of the at least three consecutively spaced needles on the rear needle bar.

15. The tufting machine of claim 13 wherein the gauge parts include a plurality of extensible loopers selectively operable to engage with loops of yarn carried by either needles from the front needle bar or needles from the rear needle bar.

16. The tufting machine of claim 13 wherein the at least three consecutively spaced needles on the front needle bar comprises at least ten consecutively spaced needles.

17. The tufting machine of claim 13 wherein the at least three consecutively spaced needles on the front needle bar comprises at least thirty consecutively spaced needles.

18. The tufting machine of claim 13 wherein the gauge parts include a plurality of extensible loopers selectively operable to engage with loops of yarn carried by only selected needles from the front needle bar.

19. The tufting machine of claim 15 wherein the control system for controls and synchronizes the extensible loopers.

20. The tufting machine of claim 18 wherein the control system for controls and synchronizes the extensible loopers.

* * * * *